US007080745B2

(12) United States Patent
Senften

(10) Patent No.: US 7,080,745 B2
(45) Date of Patent: Jul. 25, 2006

(54) MAGNETIC COUPLING AND UNCOUPLING SYSTEM FOR MODEL RAILROAD ROLLING STOCK

(76) Inventor: David A. Senften, 220 Park Charles Blvd. N., St. Peters, MO (US) 63376

( * ) Notice: Subject to any disclaimer, the term of this patent is extended or adjusted under 35 U.S.C. 154(b) by 43 days.

(21) Appl. No.: 10/797,267

(22) Filed: Mar. 10, 2004

(65) Prior Publication Data

US 2005/0199570 A1 Sep. 15, 2005

(51) Int. Cl.
*A63H 19/18* (2006.01)

(52) U.S. Cl. ..... 213/75 TC; 213/75 D; 213/211

(58) Field of Classification Search ..... 213/75 D, 213/75 TC, 212, 211; 446/138
See application file for complete search history.

(56) References Cited

U.S. PATENT DOCUMENTS

| | | | | |
|---|---|---|---|---|
| 3,469,713 | A | 9/1969 | Edwards et al. | |
| 3,564,766 | A | 2/1971 | Edwards et al. | |
| 5,048,704 | A * | 9/1991 | Takahashi | 213/75 D |
| 5,509,546 | A | 4/1996 | Staat | |
| 5,775,525 | A | 7/1998 | Brill | |

* cited by examiner

*Primary Examiner*—Mark T. Le
(74) *Attorney, Agent, or Firm*—Thompson Coburn, LLP

(57) ABSTRACT

A model railroad car magnetic coupling and uncoupling system employs pairs of cooperating magnetic couplers that have unique and simplified constructions, and an uncoupler mechanism that is mounted beneath a section of model railroad track and operates automatically to separate the mechanical couplers of two adjacent model railroad cars positioned on the section of track.

11 Claims, 6 Drawing Sheets

MAGNETIC COUPLING AND UNCOUPLING SYSTEM FOR MODEL RAILROAD ROLLING STOCK

BACKGROUND OF THE INVENTION (1) Field of the Invention

The present invention pertains to magnetic couplers that magnetically couple two adjacent model railroad cars positioned on a section of model railroad track, and an apparatus that selectively uncouples the two magnetically coupled model railroad cars.

(2) Description of the Related Art

In the hobby of model railroading there is a large group of enthusiasts that are interested in the collection, assembly and operation of smaller sized or smaller scaled model railroad layouts. Be it a desire for a model railroad layout that does not require a large expanse of space, or the challenge of assembling a realistic looking model railroad layout in a smaller scale or size, in recent years the trend in model railroading has been toward the increasing popularity of smaller and smaller scales or sizes. A first popular scale was the "O" scale, or 1:48 scale. Then came the "HO" scale, or the 1:87 scale. This was followed by the "N" scale or 1:160 scale, which was followed by the "Z" scale, or 1:220 scale.

Although the trend in model railroading has been toward the smaller and smaller scales, it has continued to be a desire of model railroaders to assemble and operate a lifelike looking model railroad. With increasingly smaller scales of model railroad cars and railroad tracks, the desire for realistic looking model railroad cars has led to some difficulties in the operating of the model railroad layouts. For example, as the scale or size of model railroad cars decreases, the size of the couplers that releasably connect adjacent model railroad cars on a section of model railroad track must also decrease to maintain a realistic appearance of the model railroad cars. The reliable operation of the couplers of model railroad cars has always been a problem in the operation of model railroad layouts, and as the scales have gotten smaller these problems have become more pronounced.

The problems encountered with the reliable operation of smaller model railroad cars exist because, as the scale of the model railroad cars gets smaller and smaller, the need for the precise construction and assembly of the coupler component parts increases proportionately. Furthermore, this is true not only in the construction of model railroad cars and their couplers, but is also true in the construction of the model railroad track and in the quality of the laying of the track in a model railroad layout. For mechanical couplers or non-magnetic couplers of model railroad cars to work well, each individual coupler of the pair to be connected must be properly aligned, both vertically and horizontally, with every other pair of couplers in use. It can easily be seen that as the scale of the model railroad cars gets smaller and smaller, this becomes more and more difficult. Irregularities in model railroad track, the dimensional tolerances of the wheels, trucks, and couplers of the model railroad cars, and the thermal stability of the model railroad track all get more critical as the scale decreases. In addition, as the scale of the model railroad cars gets smaller, the forces needed to operate the mechanical couplers pose a greater risk of causing a derailment of the cars.

In efforts to reduce the problems encountered with the operation of model railroad car couplers, manufacturers of the mechanical types of couplers that employ two or more moving parts have, in some cases, increased the size of the magnetic coupler relative to the scale of the model railroad car. However, this has the disadvantage of giving up the realism of the appearance of the railroad car and its couplers.

In addition, some mechanical couplers have been designed that can only couple and uncouple along straight lengths of track or along only slightly curved lengths of track, sacrificing the realism of the functioning of the mechanical couplers.

Another factor demonstrating the need for model railroad car couplers that function with increased reliability is the increase in computer controlled model railroad layouts. Computer controlled model railroad layouts tend to be more unattended by the individual(s) operating the layout. Therefore, computer controlled layouts require a very high degree of reliability in all aspects of the functioning of the model railroad car couplers.

The difficulties encountered in the functioning of mechanical model railroad car couplers for the smaller scale model railroad cars have been addressed by the design of model railroad car couplers that use cooperating magnetic fields to form the releasable connection between adjacent model railroad cars. Model railroad car couplers that use cooperating magnetic fields have been found to be far more reliable in coupling and uncoupling operations, but have not achieved popularity primarily because they have tended to be large in size relative to the scale of the model railroad cars, and are often complex in construction.

Another disadvantage associated with model railroad car magnetic couplers is that many require that the two adjacent model railroad cars coupled by the magnetic couplers be grasped manually and pulled apart from each other in order to uncouple the magnetic couplers. Alternatively, a wedging tool is sometimes used by inserting the tool between the adjacent coupled cars and manually applying sufficient force to physically wedge the model railroad cars apart, uncoupling the magnetic couplers. These procedures can result in causing damage to the constructions of the model railroad cars being uncoupled, or in unwanted derailments of one or both of the cars. These procedures also require direct intervention by the model railroad operator at each pair of railroad cars being uncoupled. The procedures are inconvenient in manually operated model railroad layouts, and are undesirable for computer controlled model railroad layouts.

What is needed to overcome the disadvantages associated with the couplers of smaller scale model railroad cars is an improved coupling and uncoupling system that is self-aligning, and can operate reliably when manually unattended to couple or uncouple adjacent model railroad cars without causing damage to the cars or derailments of the cars.

SUMMARY OF THE INVENTION

The model railroad car magnetic coupling and uncoupling system of the invention overcomes the disadvantages associated with prior art model railroad car coupling and uncoupling systems. The system of the invention is basically comprised of pairs of cooperating magnetic couplers that have unique and simplified constructions, and an uncoupler mechanism that is mounted beneath a section of model railroad track and operates automatically to separate the magnetic couplers of two adjacent model railroad cars positioned on the section of track.

Each magnetic coupler of a pair of magnetic couplers of the system is the same. Each coupler is comprised of a drawbar having a proximal end that mounts the coupler to an end of a model railroad car for pivoting movement of the coupler about a vertical axis. A socket with a socket cavity is provided at a distal end of the drawbar that projects from the model railroad car. A permanent magnet is secured in the socket cavity. A magnetic surface of the permanent magnet faces outwardly from the cavity. The permanent magnet is positioned in the socket cavity so that portions of both the positive and negative magnetic poles of the magnet are exposed at the magnetic surface. For example, the left half of the magnetic surface would have positive polarity or be the north half of the surface, and the right half of the magnetic surface would have negative polarity or be the south half of the surface. The polarities of the magnetic surfaces could also be reversed with the negative polarity on the left half of the magnetic surface and the positive polarity on the right half of the magnetic surface. For each of the magnetic couplers employed in the system, the positioning of the positive and negative polarity areas on the magnetic surface is the same. Thus, when two magnetic couplers are brought toward each other to connect the exposed magnetic surfaces of each of the couplers, the positive polarity area of one coupler will be opposite the negative polarity area of the other coupler, and the positive polarity area of the other coupler will be opposite the negative polarity area of the one coupler. With this arrangement of the permanent magnets of the magnetic couplers, the same magnetic couplers can be used at the opposite ends of each of the model railroad cars of the model railroad layout.

The uncoupler mechanism comprises a slide housing that is mounted beneath a section of the model railroad track by a pivot connection for pivoting movement about a horizontal axis relative to the track section. A slide arm is mounted to the slide housing for sliding, reciprocating movement of the slide arm along the length of the slide housing. The slide housing has a post that projects upwardly toward the railroad track section and the slide arm also has a post that projects upwardly toward the railroad track section.

The uncoupler mechanism also includes an elongate link that is connected to the slide housing at one end and to a bell crank arm at the opposite end. The bell crank arm is driven in rotation by an electric motor. A control circuit operates the electric motor, causing the motor to rotate the bell crank arm one complete rotation each time the control circuit is activated.

In an at rest condition of the uncoupler mechanism, both the slide housing post and slide arm post are positioned side-by-side beneath the track section. With a pair of adjacent model railroad cars positioned on the track section so that the magnetic couplers of the cars are positioned above the slide housing post and slide arm post, the control circuit of the uncoupler mechanism is actuated to automatically uncouple the magnetic couplers and separate the pair of model railroad cars.

On actuation of the control circuit, the motor begins rotation of the bell crank arm which, through the connection of the elongate link, causes the slide housing and slide arm to pivot upwardly together about the slide housing pivot connection. This positions both the slide housing post and the slide arm post above the rails of the track section and between the pair of adjacent model railroad cars coupled by their magnetic couplers. Continued rotation of the bell crank arm causes the elongate link to slide the slide arm relative to the slide housing. This causes the slide housing post and the slide arm post to separate from each other between the rails of the model railroad track segment. The slide housing post comes into engagement with one of the coupled model railroad cars and the slide arm post comes into engagement with the other of the coupled model railroad cars. Continued separation of the slide housing post and the slide arm post pushes the pair of coupled model railroad cars apart and uncouples their magnetic couplers. As the bell crank arm is continued to be rotated through one complete rotation by the motor, the slide housing post and slide arm post move back toward each other and the slide housing is pivoted downwardly, positioning the slide housing post and slide arm post side-by-side beneath the model railroad track section in the at rest position of the uncoupler mechanism.

Thus, the magnetic couplers of the invention and the uncoupler mechanism of the invention provide a coupling and uncoupling system for model railroad cars that is both unique and simplified in construction, yet provides reliable coupling and uncoupling of model railroad cars without requiring manual assistance and without potentially causing damage to the model railroad cars or derailment of the model railroad cars.

BRIEF DESCRIPTION OF THE DRAWINGS

Further features of the invention are set forth in the following detailed description of the preferred embodiment of the invention and in the drawing figures wherein.

DETAILED DESCRIPTION OF THE PREFERRED EMBODIMENT

The model railroad car magnetic coupling and uncoupling system of the invention is designed for use with the large variety of model railroad cars and model railroad track currently available, but is primarily designed for use with the smaller scale model railroad cars and track. The design of the magnetic couplers and the uncoupling system is well suited for use in the smaller scale model railroad cars and enables the use of more realistic appearing couplers with these cars. It should be understood that by referring to model railroad cars in the detailed description to follow, it is intended that the use of the magnetic coupling and uncoupling system of the invention not be limited to use with any particular type of model railroad car, or any particular size or scale of model railroad car.

Figure 1:
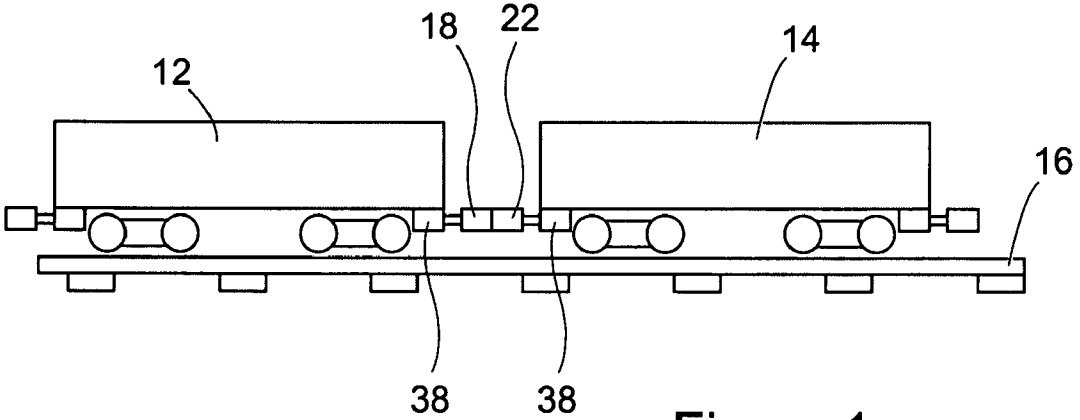
FIG. 1 is a schematic representation of a side view of a pair of model railroad cars coupled by the magnetic couplers of the invention.

FIG. 1 shows a general representation of two model railroad cars 12, 14, mounted for rolling movement on a section of track 16 where the model railroad cars are coupled by magnetic couplers 18, 22 of the present invention. As shown in FIG. 1, a pair of magnetic couplers 18, 22 is mounted to each model railroad car 12, 14 at the opposite ends of the cars. For some types of model railroad cars, there would be only one magnetic coupler 18, 22, mounted to one-end of the car. However, because of the design of the magnetic couplers 18, 22 that enables them to be mounted at either end of a model railroad car, employing only one coupler does not present a problem. The one coupler mounted on a railroad car will still be able to magnetically couple to the magnetic couplers 18, 22 of another car due to the symmetric construction of the couplers to be explained.

Figure 2:
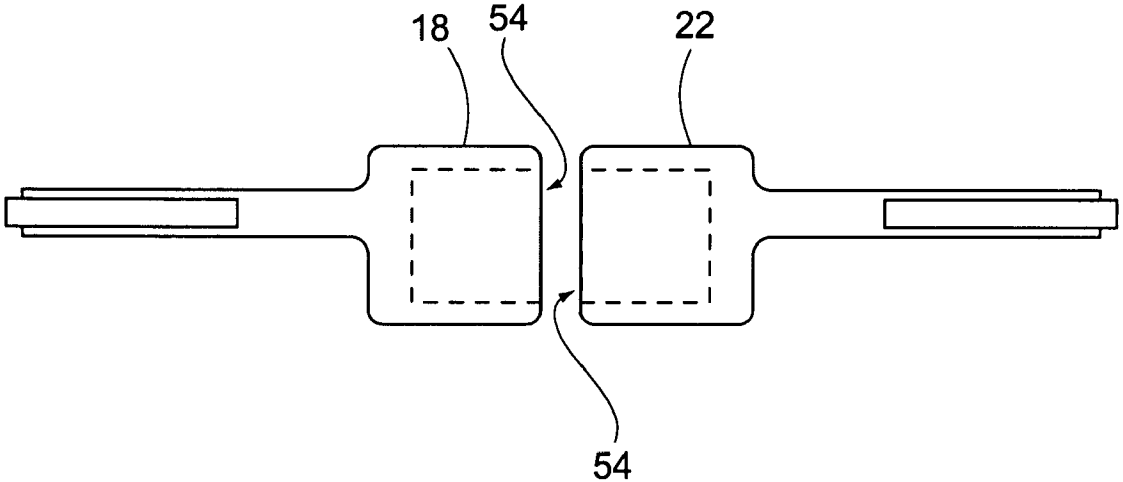
FIG. 2 is a side view of the magnetic couplers of FIG. 1 removed from the model railroad cars.

FIG. 2 shows an enlarged view of the magnetic couplers 18, 22 of the invention removed from the model railroad cars 12, 14. The construction of the couplers 18, 22 is the same. Therefore, the construction of only one coupler 18 will be described in detail.

Figure 4:
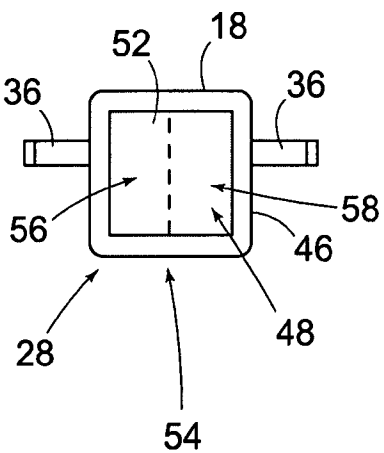
FIG. 4 is an end view of the magnetic coupler of FIG. 3.
Figure 3:
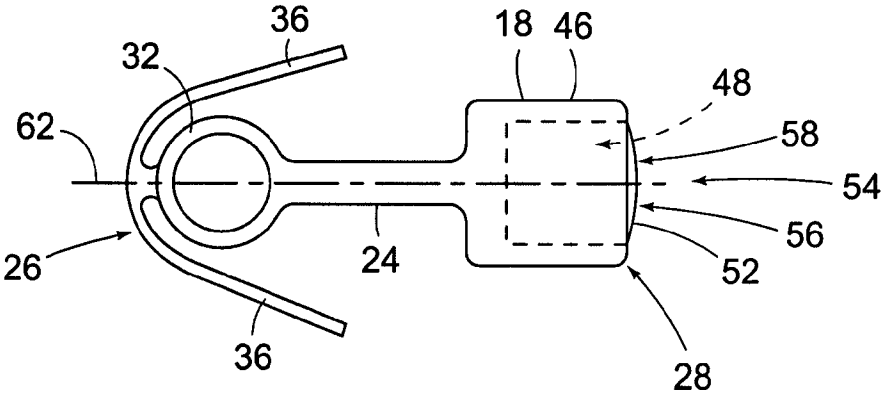
FIG. 3 is a plan view of one of the magnetic couplers of the invention.

FIG. 3 shows a top view of the magnetic coupler 18 shown to the left in FIG. 2. FIG. 4 shows an end view of the magnetic coupler 18 shown in FIG. 3. Each magnetic coupler is comprised of an elongate draw bar 24 having opposite proximal 26 and distal 28 ends. In the illustrative embodiment, the draw bar 24 is constructed of a plastic material, although other types of materials may be employed. A pivot ring 32 is formed integrally at the proximal end 26 of the draw bar. The pivot ring 32 receives a pivot post 34 of the model railroad car, mounting the draw bar 24 to the end of the model railroad car for side to side pivoting movement of the draw bar distal end 28.

Figure 5:
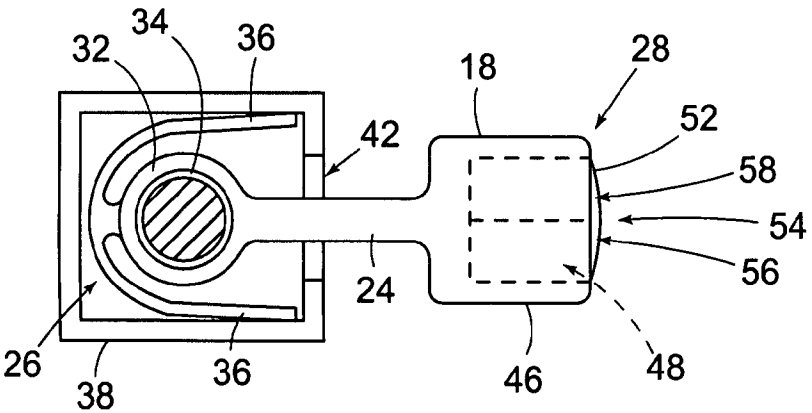
FIG. 5 is a view of the magnetic coupler of FIG. 3 mounted in a mounting box of one of the model railroad cars shown in FIG. 1.

A pair of leaf springs 36 are integrally formed at the draw bar proximal end 26 and project outwardly at angles around the pivot ring 32, as shown in FIG. 3. The leaf springs 36 engage against the opposite interior surfaces of a coupling box 38 of the model railroad car to bias the draw bar 24 to a centered position relative to the box 38, as shown in FIG. 5. FIG. 5 also shows the draw bar 24 extending through an opening 42 in the coupling box 38 of the model railroad car. Thus, the bias exerted by the pair of leaf springs 36 against the opposite interior surfaces of the model railroad car coupling box 38 automatically centers the length of the draw bar 24 relative to the length of the model railroad cars 12, 14.

A hollow socket 46 is formed integrally at the draw bar distal end 28. The socket 46 has a hollow cavity 48 that is recessed into the end face of the socket. The exterior surface of the socket 46 is shown having a general cubic configuration. The exterior surface could be configured to give the socket 46 a more realistic appearance to that of an actual railroad car coupler. The socket cavity 48 also has a cubic configuration, but could also be given different shaped configurations.

A permanent magnet 52 is secured in the socket cavity 48 by adhesives or other equivalent means. The permanent magnet 52 is dimensioned so that it substantially fills the socket cavity 48 with a magnetic surface 54 of the permanent magnet facing outwardly from the socket cavity 48. In the preferred embodiment the magnetic surface 54 is curved or convex horizontally and projects slightly outwardly from the socket cavity 48. However, the surface could be flat. The permanent magnet 52 is positioned in the socket cavity so that portions of both the positive 56 and negative 58 magnetic poles of the magnet are exposed at the magnetic surface. As shown in FIG. 4, the left half 56 of the exposed magnetic surface has a positive polarity or is the north half of the permanent magnet surface, and the right half 58 of the magnetic surface has a negative polarity or is the south half of the surface. The polarities of the magnetic surfaces could be reversed with the negative polarity surface on the left half of the exposed magnetic surface and the positive polarity surface on the right half of the exposed magnetic surface. In the preferred embodiment of the invention, the positive magnetic surface area 56 and the negative magnetic surface area 58 of the exposed surface of the permanent magnet 52 are separated by a center line 62 of the drawbar 24. Thus, the drawbar 24 is symmetric on opposite sides of the center line 62. For each of the magnetic couplers employed in the system, the positioning of the positive 56 and negative 58 polarity areas on the magnetic surface is the same. Thus, when two magnetic couplers 18, 22 are brought toward each other as shown in FIGS. 1 and 2 to connect the exposed magnetic surfaces of each of the couplers, the positive polarity area of one coupler will be opposite the negative polarity area of the other coupler, and the positive polarity area of the other coupler will be opposite the negative polarity area of the one coupler. With this arrangement of the permanent magnets 52 of the magnetic couplers 18, 22, the same magnetic couplers can be used at the opposite ends of each of the model railroad cars of the model railroad layout.

In an alternate embodiment of the magnetic couplers 18, 22, one of the permanent magnets could be replaced with other types of magnetic materials. These would be arranged in a left side and right side arrangement as shown in FIG. 4 so that the permanent magnet of one coupler is drawn to the magnetic material of the opposite coupler.

Figure 6:
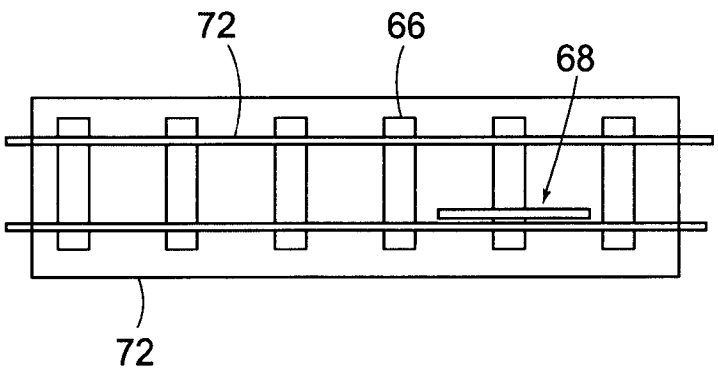
FIG. 6 is a plan view of the model railroad track section beneath which an uncoupler mechanism of the invention is mounted.

The model railroad car magnetic coupling and uncoupling system of the invention also comprises an uncoupler mechanism 64 that is mounted beneath a section of model railroad track 66 such as that shown in FIG. 6. The section of track 66 is only one example of the type of model railroad track with which the uncoupler mechanism 64 could be used. The track section 66 differs from conventional track sections in that it is provided with an elongate slot 68 through the track section between the track rails 72. To uncouple a pair of model railroad cars 12, 14 coupled together by a pair of the magnetic couplers 18, 22 of the invention, the model railroad cars must be positioned relative to the slot 68 in the positions shown in FIG. 7, with the magnetic couplers 18, 22 positioned directly above the elongate slot 68. In addition, an opening would be provided through the supporting surface of the model railroad layout to provide access for the uncoupler mechanism through the layout opening and through the elongate slot 68 of the track section 66.

Figure 7:
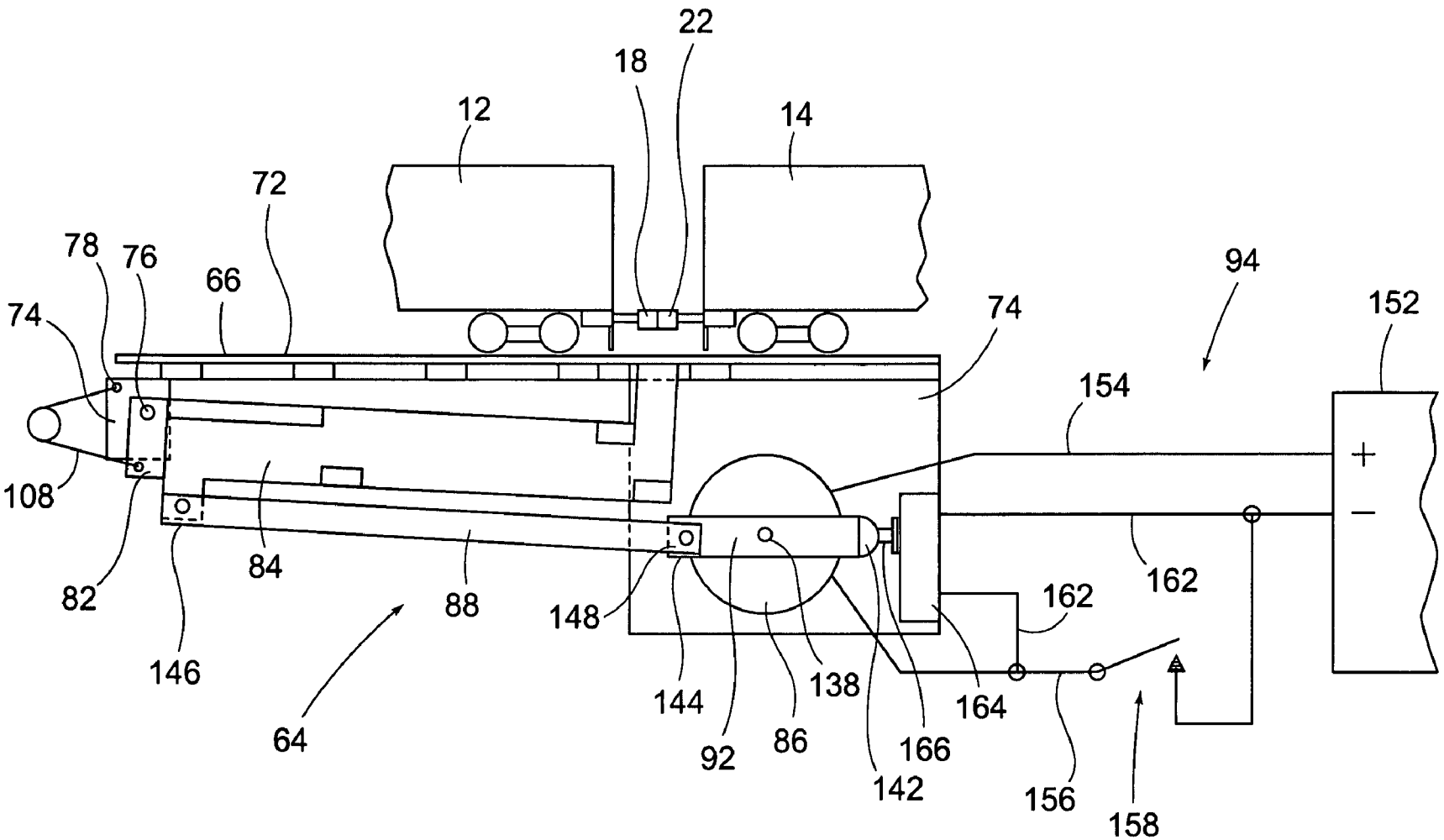
FIG. 7 is a side view of the uncoupler mechanism of the invention in a first stage of operation.
Figure 8:
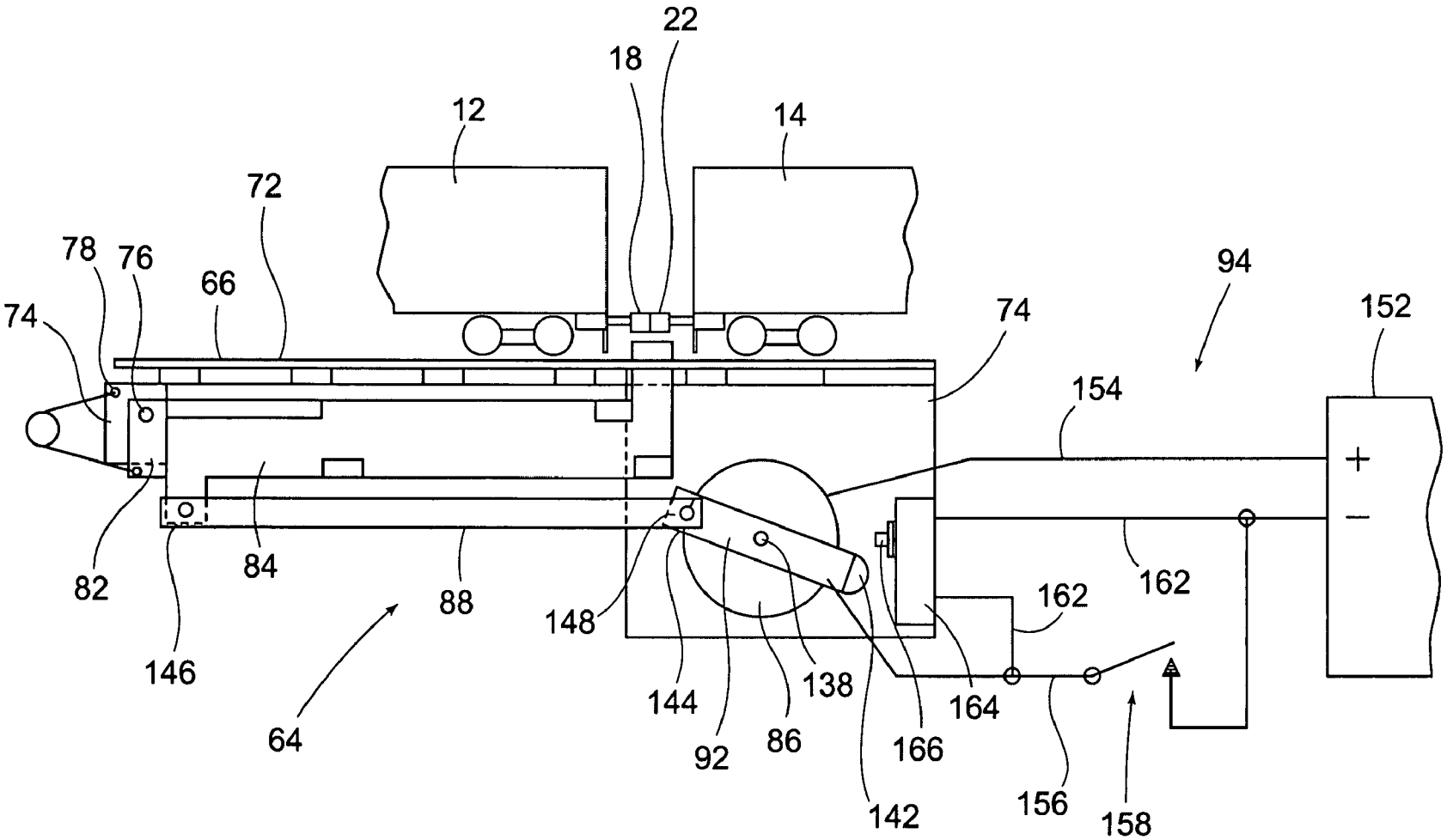
FIG. 8 is a side view of the uncoupler mechanism in a second stage of operation.
Figure 9:
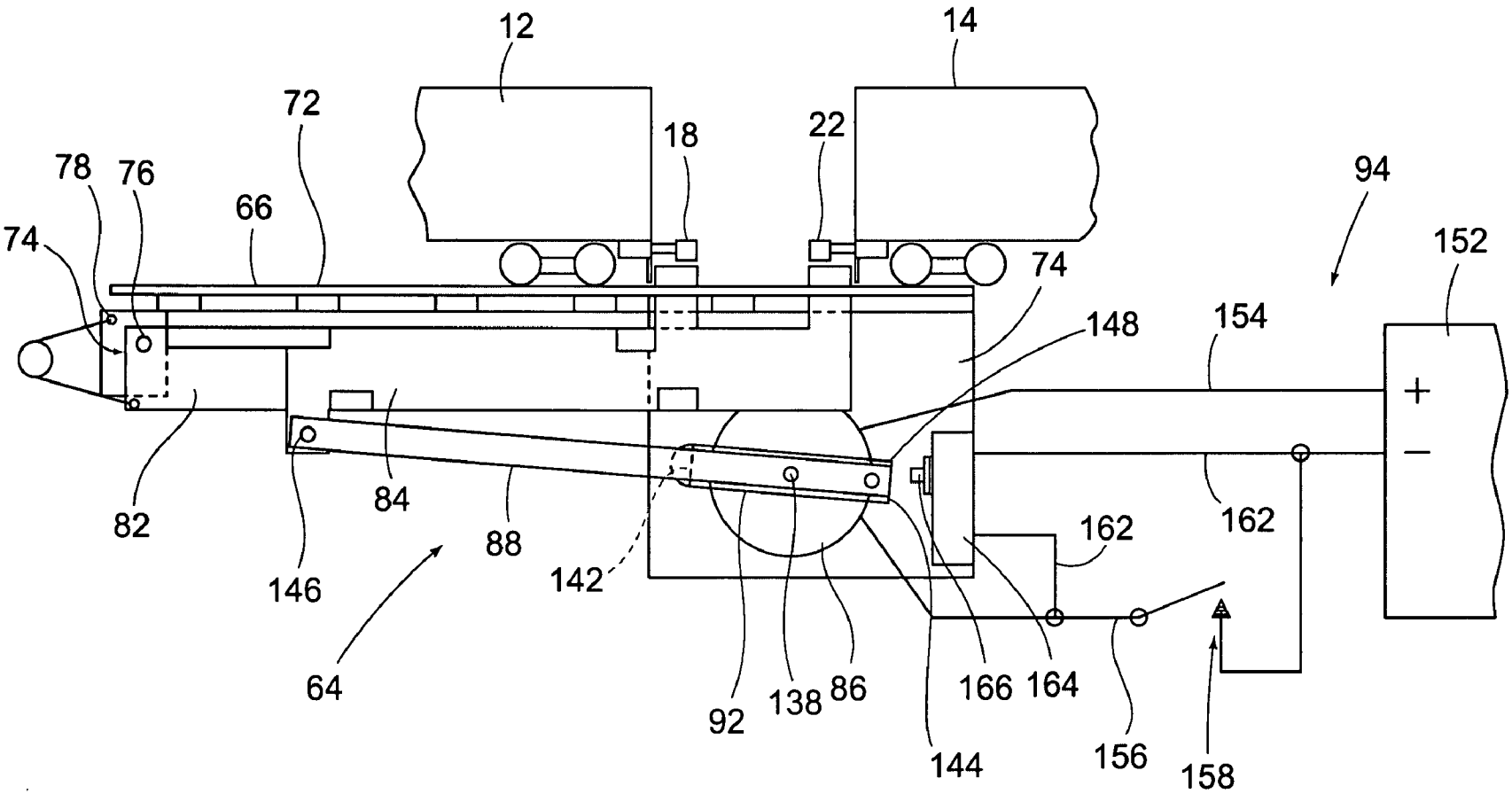
FIG. 9 is a side view of the uncoupler mechanism in a third stage of operation.
Figure 12:
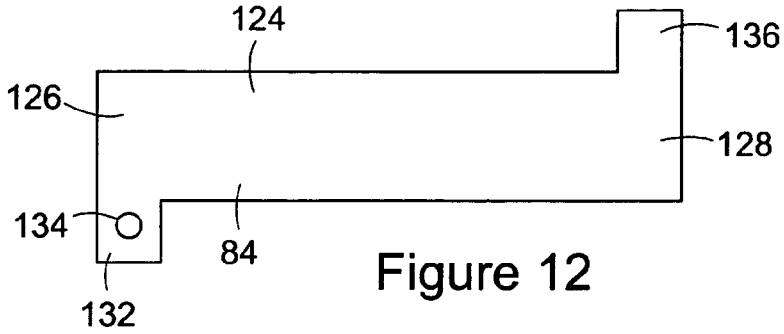
FIG. 12 is a side view of the slide arm of the uncoupler mechanism removed from the mechanism.

FIGS. 7–9 show the uncoupler mechanism 64 assembled beneath the model railroad layout and beneath the track section 66. The uncoupler mechanism is held suspended beneath the model railroad layout by an uncoupler mechanism support 74 that is attached to the underside of the layout beneath the elongate slot 68 in the track section 66. The uncoupler mechanical support is provided with a pivot pin 76 that suspends the uncoupler mechanism, as will be explained. The uncoupler support also has a spring hole 78 that receives a spring of the mechanism.

FIGS. 10–14 show the major component parts of the uncoupler mechanism 64. The uncoupler mechanism 64 is basically comprised of a slide housing 82 and a slide arm 84 that is mounted to the slide housing for relative, reciprocating movements. In addition, the uncoupler mechanism 64 includes an electric motor 86 that is operatively connected to the slide housing 82 and the slide arm 84 by an elongate link 88 and a bell crank arm 92. The operation of the electric motor 86 is controlled by a control circuit 94.

Figure 10:
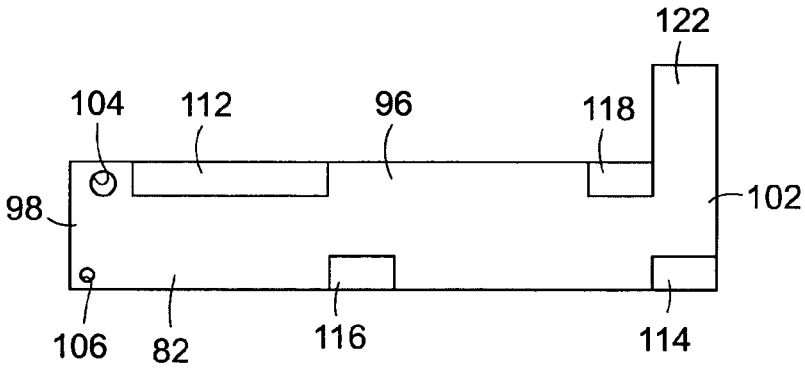
FIG. 10 is a side view of the slide housing of the uncoupler mechanism removed from the mechanism.
Figure 11:
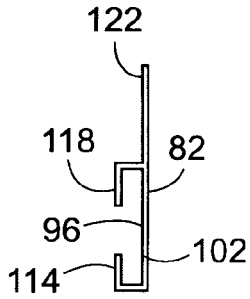
FIG. 11 is an end view of the slide housing of FIG. 10.

The slide housing 82 is shown disassembled from the uncoupler mechanism 64 in FIGS. 10 and 11. The slide housing 82 is constructed from an elongate, flat material, for example thin sheet metal or molded plastic. It is constructed with a rectangular, elongate base 96 having a proximal end 98 and an opposite distal end 102. A pivot hole 104 at the slide housing proximal end receives the pivot pin 76 of the uncoupler mechanism support, mounting the slide housing 82 to the support 74 for pivoting movement of the slide housing relative to the support. A spring hole 106 is also provided at the slide housing proximal end 98. The spring hole 106 receives one end of a small coiled spring 108 that is connected between the slide housing spring hole 106 and the uncoupler mechanism support spring hole 78. The coiled spring 108 biases the slide housing to pivot about the uncoupler mechanism support pivot pin 76 in a counterclockwise direction as viewed in FIGS. 7–9. A plurality of flanges 112, 114, 116,118 extend from upper and lower edges of the slide housing base 96 and project over the slide housing base. The flange 118 functions as a stop that limits the reciprocating movement of the slide arm 84 on the slide housing 82, which will be explained. A slide housing post 122 projects upwardly from the top edge of the slide housing distal end 102 adjacent the upper slide housing stop 118.

The slide arm 82 has a similar construction to the slide housing 82 in that it is constructed from an elongate, flat material such as thin sheet metal or molded plastic. It is constructed with a rectangular, elongate slide arm base 124 having a proximal end 126 and an opposite distal end 128. The slide arm is formed with a downwardly projecting tab 132 at its proximal end 126. A pivot pin 134 is provided on the tab 132. A slide arm post 136 projects upwardly from the top edge of the slide arm distal end 128.

Figure 13:
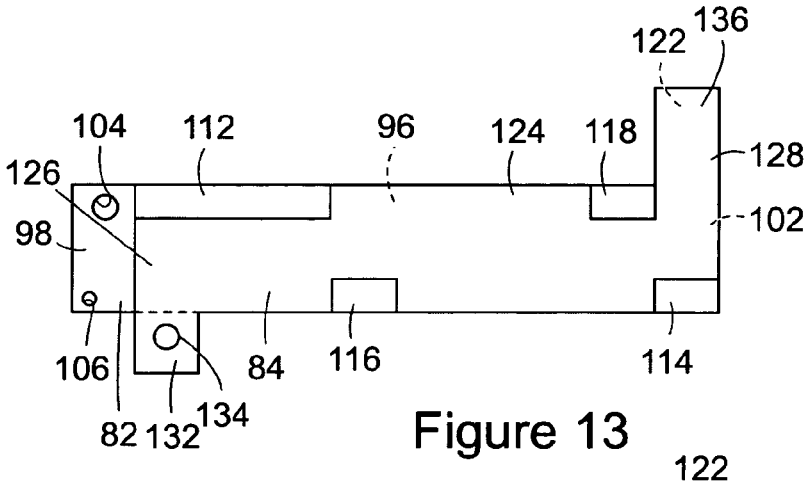
FIG. 13 is a side view of the slide arm of FIG. 12 assembled to the slide housing of FIG. 10 in at rest positions of the slide housing and slide arm.
Figure 14:
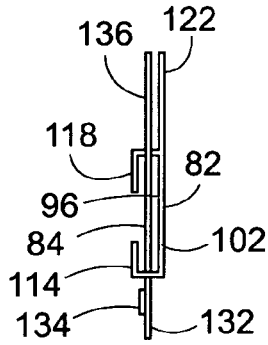
FIG. 14 is an end view of the slide housing and slide arm of FIG. 13; and, FIG. 15 is a side view of the slide housing and slide arm in the third stage positions of the slide housing and slide arm.
Figure 15:
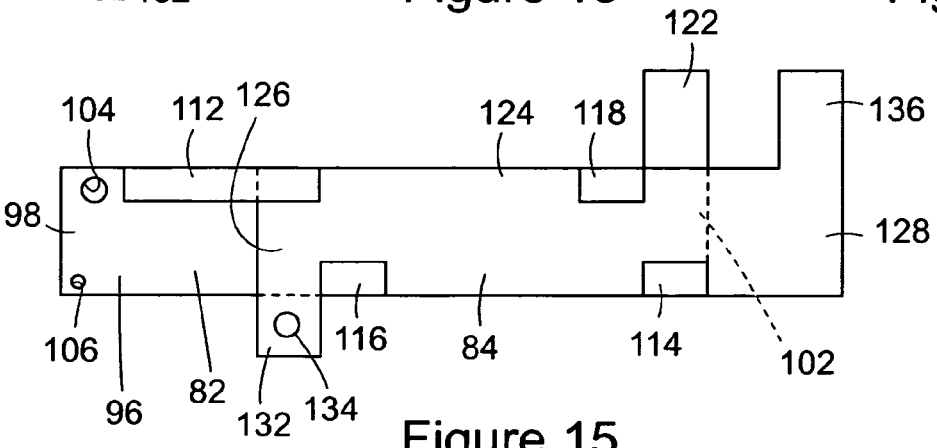

FIGS. 13, 14 and 15 show the slide arm 84 assembled to the slide housing 82 for a relative reciprocating movement. The slide arm 84 is received between the slide housing base 96 and the slide housing flanges 112, 114, 116, 118. This enables the slide arm 84 to move in a reciprocating movement relative to the slide housing 82 from first relative positions shown in FIG. 13 where the slide arm post 136 engages against the upper slide housing stop 118, and second relative positions shown in FIG. 15.

The electric motor 86 is mounted on the uncoupler mechanism support 74 adjacent the distal ends of slide housing 82 and the slide arm 84. The bell crank arm 92 has a length with opposite first 142 and second 144 ends, and is mounted to the electric motor shaft 138 intermediate its opposite ends. The first end 142 of the bell crank arm 92 is provided with a cam surface.

The elongate link 88 has a first end 146 that is pivotally connected to the pivot pin 134 on the slide arm tab 132. The opposite end 148 of the elongate link 88 is pivotally connected to the second end 144 of the bell crank arm 92.

The control circuit 94 connects the electric motor 86 to a separate power source 152. A power supply conductor 154 extends between the power source 152 and the electric motor 86. A return conductor 156 extends from the electric motor 86 through a bypass connection 158 and returns to the power source 152. A secondary conductor 162 is connected to the return conductor 156 between the electric motor 86 and the bypass connection 158. The secondary conductor 162 extends through a switch 164 before returning to the power source 152.

FIG. 7 shows an at rest condition of the uncoupler mechanism. In this condition of the uncoupler mechanism 64, both the slide housing post 122 and the slide arm post 136 are positioned side by side beneath the coupled magnetic couplers 18, 22 of two adjacent model railroad cars 12, 14. In addition, the cam surface 142 at the first end of the bell crank arm 92 engages against the switch actuator 166, opening the current path through the switch 164. With the bypass connection 158 also opened, there is not a complete current path between the power source 152 and the electric motor 86.

To initiate an uncoupling operation of the uncoupler mechanism 64, an individual or computer operating the mechanism first closes the bypass connection 158 that bypasses the open switch 164. This allows current to flow to the electric motor 86 which begins to rotate the bell crank arm 92 from its position shown in FIG. 7. This also causes the elongate link 88 and the slide arm tab 132 to move to the right as shown in FIGS. 7 and 8. The bypass connection 158 closes for only a short time after the motor 86 begins rotation of the bell crank arm 92. When the bell crank cam surface 142 disengages from the actuator 166 closing the switch 164, the bypass connection 158 opens.

Due to the bias of the spring 108, the upper slide housing stop 118 remains in contact with the slide arm post 136 and both the slide housing 82 and the slide arm 84 begin to rotate in a counterclockwise direction around the pivot pin 76 of the uncoupler mechanism support 74. This causes both the slide housing post 122 and the slide arm post 136 to move upwardly through the elongate slot 68 of the track section 66 to a position between the two adjacent model railroad cars 12,14 until top edges of the slide housing 82 and slide arm 84 engage against the underside of the track section 66.

At this point, because the slide housing 82 and slide arm 84 can no longer rotate upwardly relative to the track section 66, continued rotation of the motor shaft 138 and the bell crank arm 92 causes the elongate link 88 to pull the slide arm 84 relative to the slide housing 82, moving the slide arm 84 to the right of the slide housing 82 as shown in FIG. 8. The movement of the slide arm 84 to the right relative to the slide housing 82 separates the slide arm post 136 from the slide housing post 122. The movement of the slide arm post 136 and the slide housing post 122 away from each other causes the two posts to eventually come into contact with the two model railroad cars 12, 14. As the separating movement of the slide arm post 136 and the slide housing post 122 continues, the two posts pushing against the respective model railroad cars 12, 14 cause the magnetic couplers 18, 22 of the two cars to separate. The separation of the two model railroad cars 12, 14 continues, increasing the space between the two cars until the electric motor 86 has turned the bell crank arm 92 180 degrees, or one half of one complete rotation. At this point, the two magnetic couplers 18, 22 are spaced a sufficient distance from each other so that the attractive magnetic force between the two couplers is reduced to a level that will not pull the two couplers and their respective model railroad cars 12, 14 back together, as shown in FIG. 9.

As the bell crank arm continues to rotate beyond 180 degrees, the movement of the slide arm 84 relative to the slide housing 82 and the rotation of the slide arm 84 and slide housing 82 is reversed. The rotation of the bell crank arm 92 continues until it approaches it position shown in FIG. 7. As the rotation of the bell crank arm 92 approaches 360 degrees, the cam surface 142 at the first end of the bell crank arm 92 comes into contact with the switch actuator 166 of the circuit switch 164. This causes the switch 164 to open the electric circuit between the power source 152 and the electric motor 86, stopping further rotation of the motor shaft 138 and the bell crank arm 92. This automatically stops the uncoupler mechanism 64 in the at rest position shown in FIG. 7.

As explained above, the magnetic couplers 18, 22 of the invention and the uncoupler mechanism 64 of the invention provide a coupling and uncoupling system for model railroad cars that is both unique and simplified in construction, yet provides reliable coupling and uncoupling of model railroad cars without requiring manual assistance and without potentially causing damage to the model railroad cars or derailment of the model railroad cars.

Although the magnetic coupling and uncoupling system for model railroad rolling stock has been described above by reference to a particular embodiment of the system, it should be understood that modifications and variations may be made to the system without departing from the intended scope of protection provided by the following claims.

The invention claimed is:

1. An apparatus for controlling connections between model railroad cars, the apparatus comprising:

a drawbar having a length with opposite proximal and distal ends, the drawbar proximal end being adapted to be operatively attached to a model railroad car;

a magnetic surface at the drawbar distal end, the magnetic surface having a first surface area of a first magnetic polarity and a second surface area of a second magnetic polarity, the first magnetic polarity being opposite the second magnetic polarity;

the drawbar being a first drawbar;

a second drawbar like the first drawbar, the second drawbar having a length with opposite proximal and distal ends, the second drawbar proximal end being adapted to be operatively connected to a model railroad car;

a magnetic surface at the second drawbar distal end, the magnetic surface having a first surface area of a first magnetic polarity and a second surface area of a second magnetic polarity, the first magnetic polarity being opposite the second magnetic polarity, whereby the first drawbar is coupled to the second drawbar by engaging the magnetic surfaces of the first and second drawbars with the first and second surface areas of the first drawbar opposing the respective second and first surface areas of the second drawbar, and where the first drawbar is uncoupled from the second drawbar by separating the magnetic surfaces of the first and second drawbars; and an uncoupler mechanism having a first post and a second post that are mounted on the uncoupler mechanism for movement from first positions where the first and second posts are displaced from the first drawbar coupled to the second drawbar, to second positions where the first and second posts are positioned adjacent the first drawbar coupled to the second drawbar, and the first and second posts being mounted on the uncoupler mechanism for movement of the first and second posts from the second positions to third positions of the first and second posts where the first and second posts are spaced from each other by a distance where the first post will operatively engage with a model railroad car to which the first drawbar is attached and the second post will operatively engage with a model railroad car to which the second drawbar is attached and causes the model railroad cars to separate and cause the first drawbar magnetic surface to separate from the second drawbar magnetic surface.

2. The apparatus of claim 1, further comprising:

the first and second posts being mounted on the uncoupler mechanism by a pivot connection where the first and second posts pivot about the pivot connection when the first and second posts move from the first positions to the second positions.

3. The apparatus of claim 1, further comprising:

the first post being connected to the second post for relative linear movement between the first and second posts when the first and second posts move from the second positions to the third positions.

4. An apparatus for controlling connections between model railroad cars, the apparatus comprising:

first and second drawbars, each drawbar having a length with opposite proximal and distal ends, the proximal end of each drawbar being adapted to be operatively attached to a model railroad car and the distal end of each drawbar having a magnetic material where the magnetic material of the first drawbar is attracted to the magnetic material of the second drawbar;

an uncoupler mechanism adapted to be positioned beneath a model railroad track section that at least partially supports a first model railroad car to which the proximal end of the first drawbar has been operatively attached and at least partially supports a second model railroad car to which the proximal end of the second drawbar has been operatively attached, and where the magnetic material of the first drawbar is attracted to the magnetic material of the second drawbar causing the first drawbar distal end to engage with the second drawbar distal end, the uncoupler mechanism having a first post and a second post that are mounted on the uncoupler mechanism for movement from first positions beneath the track section to second positions where the first and second posts project above the track section in positions adjacent the engaging first drawbar distal end and second drawbar distal end, and the first and second posts being mounted on the uncoupler mechanism for movement of the posts from the second positions to third positions of the posts where the first and second posts are spaced from each other by a distance that causes the first post to operatively engage with and move the first model railroad car on the track section and causes the second post to operatively engage with and move the second railroad car on the track section causing the first drawbar distal end and the second drawbar distal end to disengage.

5. The apparatus of claim 4, further comprising:

the first and second posts being mounted on the uncoupler mechanism by a pivot connection where the first and second posts pivot about the pivot connection when the first and second posts move from the first positions to the second positions.

6. The apparatus of claim 4, further comprising:

the first post being connected to the second post for relative linear movement between the first and second posts when the first and second posts move from the second positions to the third positions.

7. The apparatus of claim 5, further comprising:

the first post being connected to the second post for relative linear movement between the first and second posts when the first and second posts move from the second positions to the third positions.

8. The apparatus of claim 4, further comprising:

a slide housing mounted on the uncoupler mechanism by a pivot connection for pivoting movement of the slide housing about the pivot connection; and, the first post being on the slide housing whereby the first post pivots with the slide housing about the pivot connection when the first post moves from the first position to the second position.

9. The apparatus of claim 8, further comprising:

a slide arm mounted on the slide housing for pivoting movement of the slide arm with the slide housing about the pivot connection, and for linearly reciprocating movement of the slide arm relative to the slide housing; and, the second post being on the slide arm whereby the second post pivots with the slide housing and slide arm about the pivot connection when the second post moves from the first position to the second position, and whereby the second post moves linearly with the slide arm relative to the slide housing when the second post moves from the second position to the third position.

10. The apparatus of claim 9, further comprising:

a link having a length with opposite first and second ends, the link first end being operatively connected to the slide arm; and a motive source operatively connected to the link second end, whereby the motive source imparts movement to the link which in turn causes pivoting movement of the slide housing about the pivot connection and causes linearly reciprocating movement of the slide arm relative to the slide housing.

11. The apparatus of claim 10, further comprising:

an electronic circuit operatively connected to the motive source to control the motive source, the electronic circuit being operable to cause the motive source to rotate the link second end in one complete rotation on each activation of the electronic circuit.

* * * * *